US007493905B2

(12) United States Patent
Jeong et al.

(10) Patent No.: US 7,493,905 B2
(45) Date of Patent: Feb. 24, 2009

(54) DISHWASHER

(75) Inventors: Mun Gyu Jeong, Gumi-si (KR); Woo Sang Woo, Busan (KR)

(73) Assignee: LG Electronics Inc., Seoul (KR)

( * ) Notice: Subject to any disclaimer, the term of this patent is extended or adjusted under 35 U.S.C. 154(b) by 537 days.

(21) Appl. No.: 11/088,950

(22) Filed: Mar. 25, 2005

(65) Prior Publication Data

US 2005/0241682 A1 Nov. 3, 2005

(30) Foreign Application Priority Data

May 3, 2004 (KR) ..... 10-2004-0030945
May 3, 2004 (KR) ..... 10-2004-0030946

(51) Int. Cl.
*B08B 3/00* (2006.01)

(52) U.S. Cl. ..... 134/56 D

(58) Field of Classification Search ..... 211/41.8, 211/41, 151, 41.4, 41.9, 126.1, 153, 181.1; 312/301, 311, 410, 408, 351; D32/3; 134/56 D, 134/200, 201, 144, 184, 25.2, 25.4, 52, 57 DL, 134/58 DL, 92, 135, 56 R, 57 D, 57 R, 58 D, 134/58 R; 220/488, 549, 544, 487
See application file for complete search history.

(56) References Cited

U.S. PATENT DOCUMENTS 2,103,885 A * 12/1937 Whalen ..... 312/404
3,021,185 A * 2/1962 Kowalczyk ..... 312/29
3,556,625 A * 1/1971 Kauffman ..... 312/301
3,901,726 A * 8/1975 Snearly ..... 134/1

FOREIGN PATENT DOCUMENTS

EP 0 186 157 * 7/1996

* cited by examiner

*Primary Examiner*—Michael Kornakov
*Assistant Examiner*—Stephen Ko
(74) *Attorney, Agent, or Firm*—McKenna Long & Aldridge LLP

(57) ABSTRACT

Provided is a dishwasher that is convenient in use. The dishwasher includes: a tub having therein a space for washing dishes; a top rack including at least one receiving container in which the dishes are received; a top rack guide disposed at an inner ceiling of the tub such that the top rack is received; and a fixing unit for fixing the top rack guide to the inner ceiling of the tub.

12 Claims, 7 Drawing Sheets

DISHWASHER

This application claims the benefit of Korean Application Nos. P2004-30945 and P2004-30946 both filed on May 3, 2004 which are hereby incorporated by reference as if fully set forth herein.

BACKGROUND OF THE INVENTION

1. Field of the Invention

The present invention relates to a dishwasher, and more particularly, to a dishwasher that is convenient in use.

2. Discussion of the Related Art

In general, a dishwasher is to wash dishes and dry the washed dishes by spraying washing water pumped by a washing pump onto the dishes received in a rack.

FIG. 1 is a perspective view of a general dishwasher according to the related art.

Referring to FIG. 1, the dishwasher 10 includes a tub 11, upper and lower racks 16 and 17, upper and lower nozzles 14 and 15, and a water guide 12. The tub 11 constitutes the exterior of the dishwasher 10 and has therein a space for receiving and washing dishes. A door for opening and closing an inner space of the tub 11 is provided at a front side of the tub 11.

The upper and lower racks 16 and 17 are respectively disposed at an inner upper portion and an inner lower portion of the tub 11, for receiving the dishes. A sump is disposed below the lower rack 17. The sump stores washing water used for washing the dishes. The sump is connected with a pump for pumping the washing water. The pump sucks the washing water stored in the sump and then pumps the washing water at a high pressure. The pumped washing water is transferred upward along the water guide 12.

A top nozzle 13 and the upper nozzle 14 are respectively disposed above and below the upper rack 16, and the lower nozzle 15 is disposed below the lower rack 17. The upper and lower nozzles 14 and 15 are connected with the water guide.

Accordingly, when the dishes are received in the upper and lower racks 14 and 15, the door is closed and a power is applied to the dishwasher 10, the washing water is pumped by the pump. The pumped washing water passes through the water guide 12 and is sprayed onto the dishes received in the upper and lower racks 16 and 17 through the nozzles 13, 14 and 15.

However, the related art dishwasher has the following drawbacks:

First, since the racks are provided at two places inside the tub, the inner space of the tub cannot be sufficiently utilized; and Secondly, since the racks do not have a space for receiving dishes having a small volume such as spoon and chopsticks bristolfashion, it is problematic to separately install a receiving tool in a space of the racks.

SUMMARY OF THE INVENTION

Accordingly, the present invention is directed to a dishwasher that substantially obviates one or more problems due to limitations and disadvantages of the related art.

An object of the present invention is to provide a dishwasher that is convenient in use.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, there is provided a dishwasher, which includes: a tub having therein a space for washing dishes; a top rack including at least one receiving container in which the dishes are received; a top rack guide disposed at an inner ceiling of the tub such that the top rack is received; and a fixing unit for fixing the top rack guide to the inner ceiling of the tub.

The top rack is transferred while frictionally sliding along the top rack guide.

Also, the top rack includes: at least two receiving containers for receiving the dishes; and a rack frame having receiving parts for independently supporting the receiving containers and sliding along the top rack guide. The rack frame is made of a metal bar bent several times.

The top rack guide has at least one fixing protrusion disposed at an upper portion thereof and fixed by the fixing unit. The fixing unit includes: a fixing plate fixed to the inner ceiling of the tub and having a fixing groove into which the fixing protrusion is inserted; and a fixing member for preventing the fixing protrusion inserted into the fixing groove from releasing. The fixing member includes: a restraining part for restraining the fixing protrusion inserted into the fixing groove; and an extending part extending from the restraining part and coupled with the fixing plate.

Meanwhile, the top rack guide includes: guide rails having insertion holes into which both sides of the top rack are movably inserted in front and rear directions; and a connection part connecting the guide rails. The connection part is made of a metal bar and has a fixing protrusion bent in the shape of "L" at an upper portion thereof, the fixing protrusion having an end protruded toward a rear side of the tub.

The fixing unit includes: a fixing plate fixed to an inner circumference of the tub and having a fixing groove into which the fixing protrusion is inserted; and a fixing member for fixing the inserted fixing protrusion.

The fixing unit includes: a restraining part for restraining the fixing protrusion inserted into the fixing groove; and an extending part extending from the restraining part and inserted into and fixed to stepped portions formed at both sides of the fixing groove. Each of the stepped portions has a groove, and the extending part has a hook formed at a lower portion thereof and inserted into the groove of the stepped portion and a pushing protrusion formed at an upper portion thereof, for pushing the fixing protrusion in a direction of the groove.

Another aspect of the present invention, there is provided a dishwasher, which includes: a tub having therein a space for washing dishes; a top rack including at least one receiving container in which the dishes are received; a top rack guide having at least one fixing protrusion formed at an upper portion thereof, the fixing protrusion having an end portion protruded toward a rear side of the tub, the top rack guide being disposed at an inner ceiling of the tub, for guiding a front and rear transfer of the top rack; and a fixing unit for detachably fixing the fixing protrusion to the inner ceiling of the tub.

The fixing unit includes: a fixing plate fixed to an inner circumference of the tub and having a fixing groove into which the fixing protrusion is inserted; and a fixing member for fixing the inserted fixing protrusion.

The fixing unit includes: a restraining part for restraining the fixing protrusion inserted into the fixing groove; and an extending part extending from the restraining part and inserted into and fixed to stepped portions formed at both sides of the fixing groove.

Each of the stepped portions has a groove, and the extending part has a hook formed at a lower portion thereof and inserted into the groove of the stepped portion and a pushing protrusion formed at an upper portion thereof, for pushing the fixing protrusion in a direction of the groove. The fixing protrusion is made of a metal bar bent in the shape of "L".

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

Hereinafter, a dishwasher according to a preferred embodiment of the present invention will be described in detail with reference to FIGS. 2 through 7.

Figure 2:
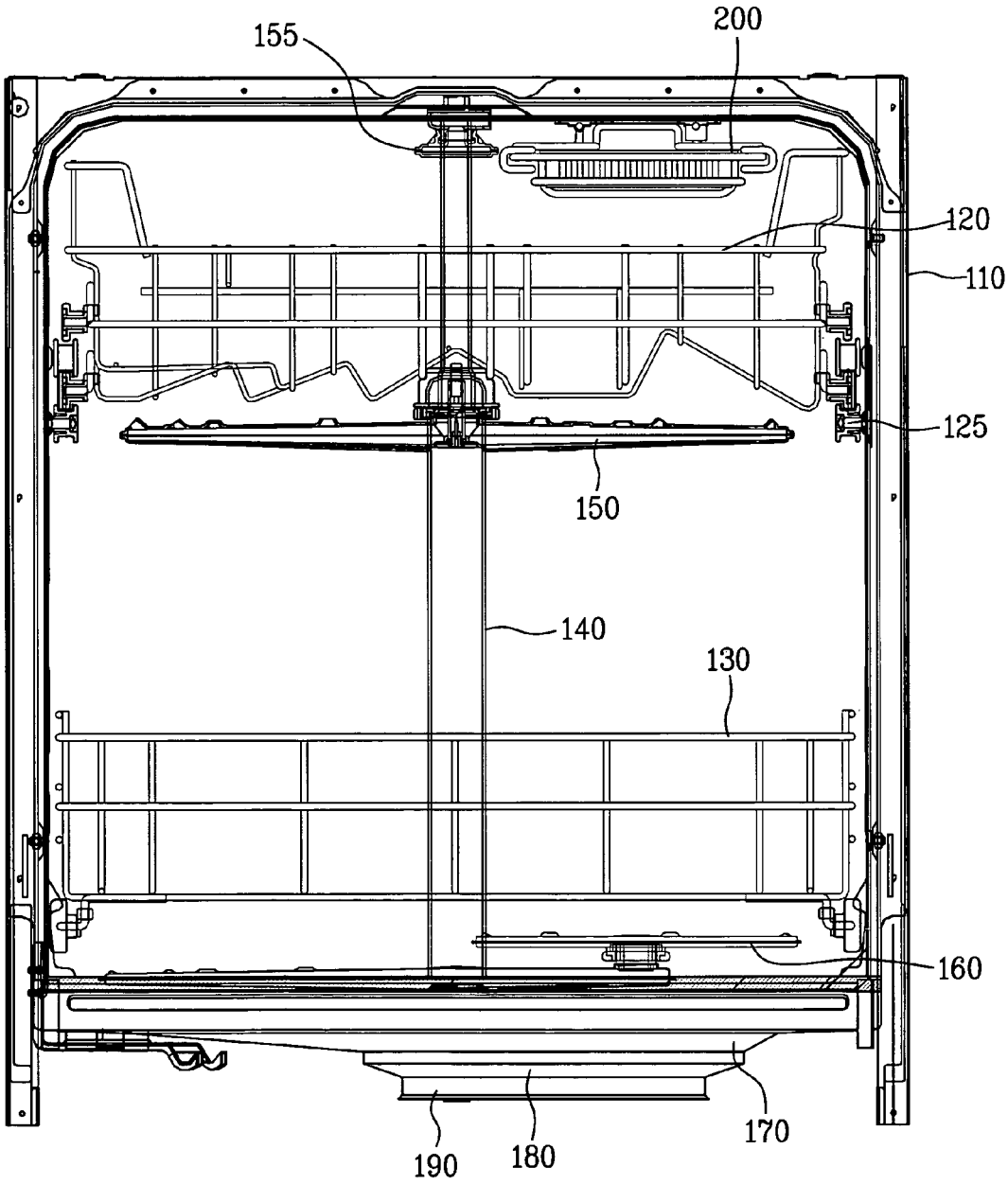
FIG. 2 is a front view of a dishwasher according to an embodiment of the present invention.

FIG. 2 is a front view of a dishwasher according to the present invention.

Referring to FIG. 2, the dishwasher includes a tub 110, racks 120, 130 and 200, a washing pump 180, and a sump 170.

The tub 110 constitutes the exterior of the dishwasher and has therein a space for receiving and washing dishes. The sump 170, which stores washing water therein, is disposed at a lower center portion of the tub 110. An air brake (not shown) for controlling flow rate of the washing water supplied to the sump 170 is disposed at an outer side portion of the tub 110.

The sump 170 is connected with the washing pump 180 for pumping the washing water at a high pressure, and the washing pump 180 is connected with a motor 190.

Meanwhile, it is preferable that the upper rack 120 and the lower rack 130 be respectively disposed at an upper side and a lower side of the washing space and the top rack 200 be disposed above the upper rack 120.

A top nozzle 155 and an upper nozzle 150 are respectively disposed at an upper side and a lower side of the upper rack 120, and a lower nozzle 160 is disposed below the lower rack 130. A plurality of spraying holes are respectively formed at an upper surface of the upper nozzle 150, an upper surface of the lower nozzle 160, and a side surface and a lower surface of the top nozzle 155. The washing water pumped by the washing pump 180 flows along the water guide 140 connected with the nozzles 150, 160 and 155.

Accordingly, the dishes received in the racks 120, 130 and 200 are washed by the washing water sprayed through the spraying holes formed at the nozzles 150, 160 and 155. At this time, it is preferable that the nozzles 150, 160 and 155 spray the washing water while rotating. Also, it is preferable that the upper rack 120 and the lower rack 130 be designed to be movable in a front and rear direction along rails mounted on inner side surfaces of the tub 110.

Next, operation of the dishwasher will be described.

A door of the dishwasher is first opened, dishes are loaded in the racks 120 and 130 disposed in the washing space, the door is closed, and a power is applied to perform a washing operation, so that washing water is introduced into the sump 170.

Thereafter, as an impeller disposed inside the washing pump 180 connected with the motor 190 rotates, the washing water is guided along the water guide 140 and then sprayed through the spraying holes formed at the nozzles 150, 160 and 155. The sprayed washing water washes the dishes received in the racks 120 and 130.

The washing water used in washing the dishes is withdrawn to the sump 170 and then again sprayed toward the dishes. At this time, contaminants contained in the washing water are filtered. After the washing operation is completed, the washing water is discharged to an outside by a discharge pump.

After that, clean washing water is again introduced into the sump, and a rinsing operation for spraying the clean washing water onto the dishes through the nozzles is performed. After the rinsing operation, a drying operation is performed.

Meanwhile, in order to more effectively utilize the inner space of the tub 110, it is preferable that the top rack 200 be disposed at a ceiling of the washing space formed inside the tub 110, as described above. Accordingly, the dishes received in the top rack 200 can be washed by the washing water sprayed from the top nozzle 155 and the upper nozzle 150.

Hereinafter, an installation structure of the top rack 200 will be described in more detail.

Figure 3:
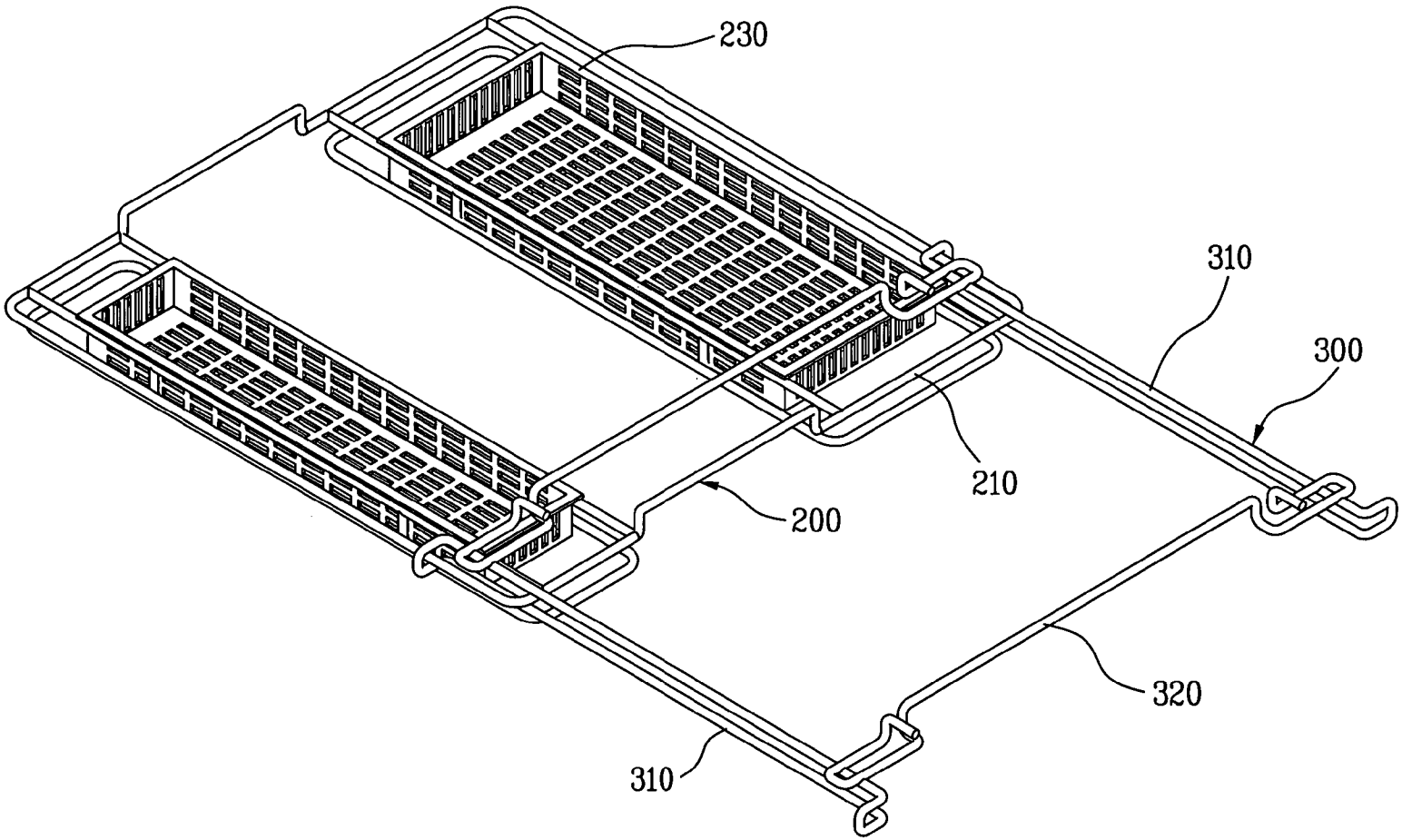
FIG. 3 is a perspective view illustrating an installation structure of a top rack according to the present invention.

FIG. 3 is a perspective view illustrating an installation structure of a top rack according to the present invention.

Referring to FIG. 3, the top rack 200 is movable by frictionally sliding along the top rack guide 300. Accordingly, the top rack guide 300 does not need a separate roller or the like.

Preferably, the top rack guide 300 is fixed to the ceiling of the washing space formed inside the tub 110. By doing so, the top rack 200 can be installed at the ceiling of the washing space, so that the utilization of the inner washing space can be enhanced.

The top rack 200 includes at least one receiving container 230 for receiving the dishes, and a rack frame 210 supporting the receiving container 230 and sliding along the top rack guide.

As shown in FIG. 3, it is preferable that the top rack 200 include at least two receiving containers 230 in which the dishes are received. By doing so, the dishes can be effectively received in the receiving containers 230 according to kinds of the dishes. Also, the rack frame 210 has receiving parts for independently receiving the receiving containers 230 and is movable slidingly in a front and rear direction along the top rack guide 300.

To support the receiving containers 230, it is preferable that the rack frame 210 is made of a metal bar bent and welded.

Meanwhile, the top rack guide 300 is made of a metal bar bent and welded. In detail, the top rack guide 300 includes a pair of guide rails 310 extending in a front and rear direction along both sides of the top rack 200, and a connection part 320 connecting the pair of guide rails 310. The connection part 320 connects both front ends of the guide rails 310 and connects both rear ends. Accordingly, both sides of the top rack 200 can be movable in a front and rear direction along the guide rails 310.

Figure 4:
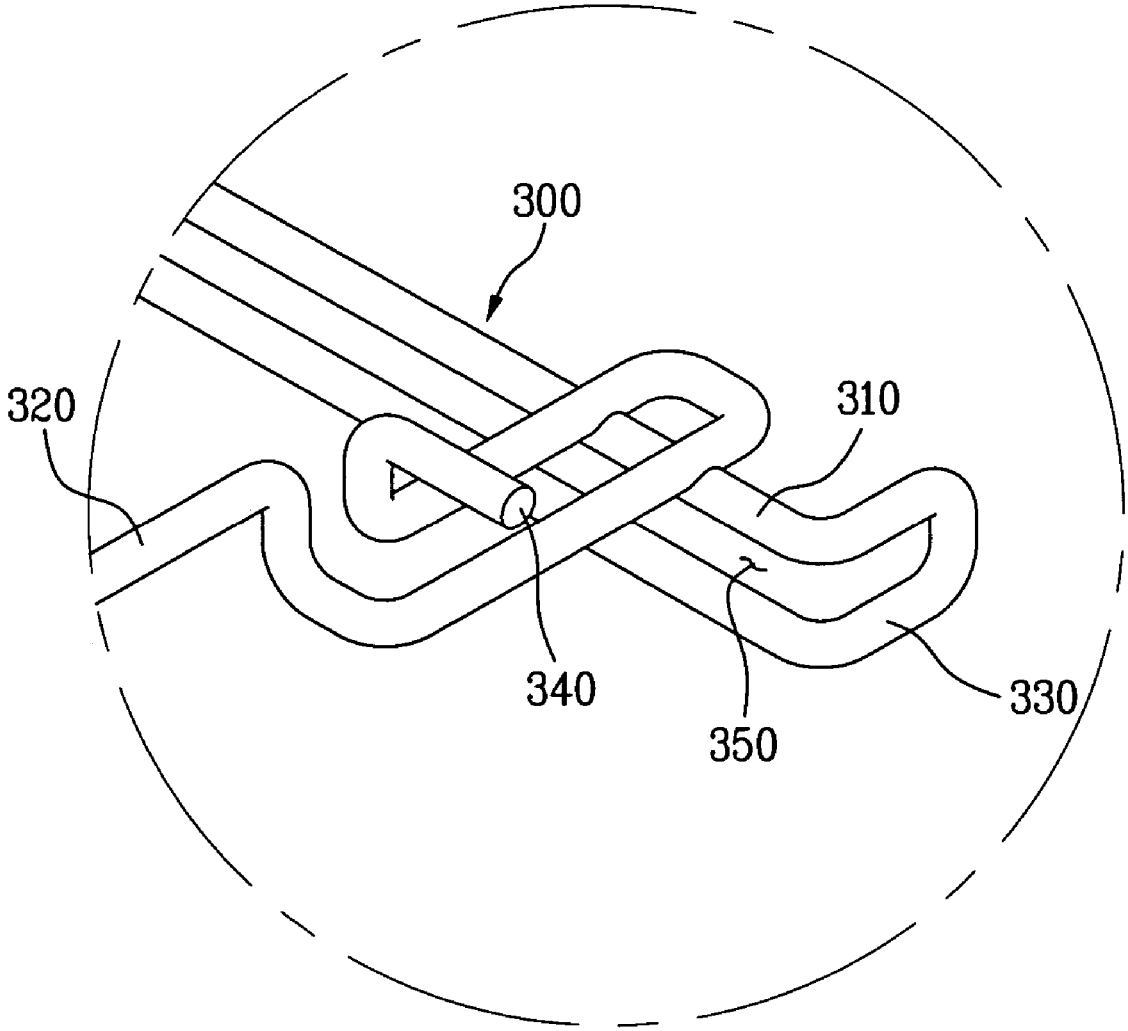
FIG. 4 is a partial perspective view illustrating a main portion of a top rack guide according to the present invention.
Figure 5:
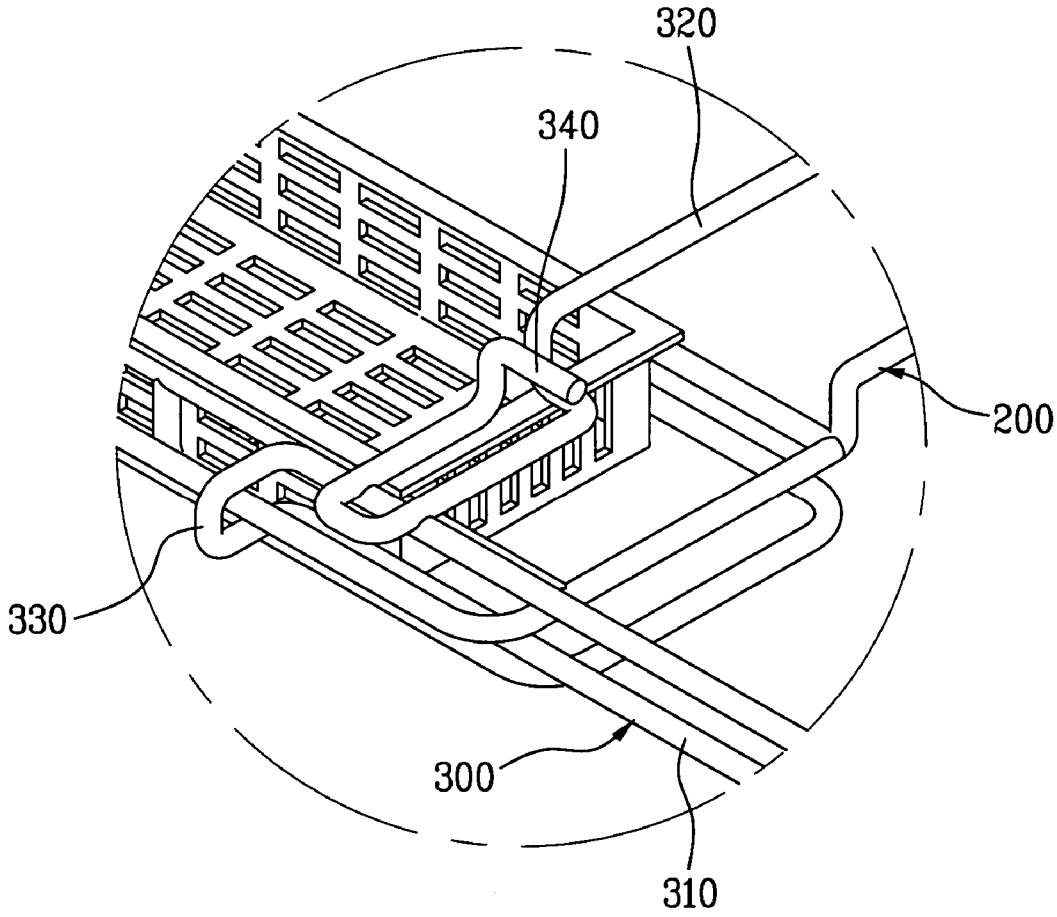
FIG. 5 is a partial perspective view illustrating that a top rack according to the present invention is inserted into a top rack guide.

FIG. 4 is a partial perspective view illustrating a main portion of a top rack guide according to the present invention, and FIG. 5 is a partial perspective view illustrating that a top rack according to the present invention is inserted into a top rack guide.

Referring to FIGS. 4 and 5, the top rack guide 300 is made of a metal bar bent and welded. The top rack guide 300 has an insertion hole 350 into which both sides of the top rack 200 are inserted. In detail, it is preferable that the rack frame 210 of the top rack 200 be inserted into the insertion hole 350 and be movable along the top rack guide 300 in the front and rear direction.

Also, both ends of the top rack guide 300 are bent outwardly such that the rack frame 210 can pass through, and have a supporting part 330 formed at the bent portion. Accordingly, the top rack 200 is movable in the front and rear direction or is separable from the top rack guide 300.

In detail, since the top rack 200 has a width that is slightly greater than an interval between the pair of top rack guides 300, the rack frame 210 disposed at both sides of the top rack 200 is supported by an upper surface of the supporting part 330.

Meanwhile, the guide rails 310 are connected by the connection part 320. The connection part 320 may be formed integrally with the guide rails 310 or formed of a separate metal bar welded to the guide rails 310. As shown in the drawings, it is preferable that the connection part 320 be respectively formed at the front side and the rear side of the guide rails 310.

Meanwhile, the top rack guide 300 is fixed to an inner upper surface of the tub (see 110 of FIG. 2) by a fixing unit to be described later.

For this purpose, at least one fixing protrusion 340 whose an end is protruded toward a rear of the tub 110 is disposed above the top rack guide 300.

In detail, it is preferable that the fixing protrusion 340 be disposed on both ends of the connection part 320 bent several times such that the fixing protrusion 340 is inserted into the fixing unit. As shown in the drawings, the fixing protrusion 340 is bent in the shape of 'L' at an end of the connection part 320. At this time, it is preferable that an end of the fixing protrusion 340 be bent toward the rear of the tub.

Next, a process for manufacturing the top rack guide will be described.

First, the guide rail 310 is made of a metal bar whose both ends are bent in the shape of "⊂ ⊃" and have a diameter and a length. Also, both ends of the guide rail are bent outwardly, so that the supporting part 330 into which the rack frame 210 of the top rack 200 is inserted is formed.

The pair of guide rails 310 are connected by the connection part 320 at the front side and the rear side thereof. It is preferable that the connection part 320 is welded and fixed to the pair of guide rails 310. Each of both ends of the connection part 320 is first bent upward and then again bent toward the rear of the tub such that it severs as the fixing protrusion 340 inserted into and fixed to the fixing unit.

Figure 6:
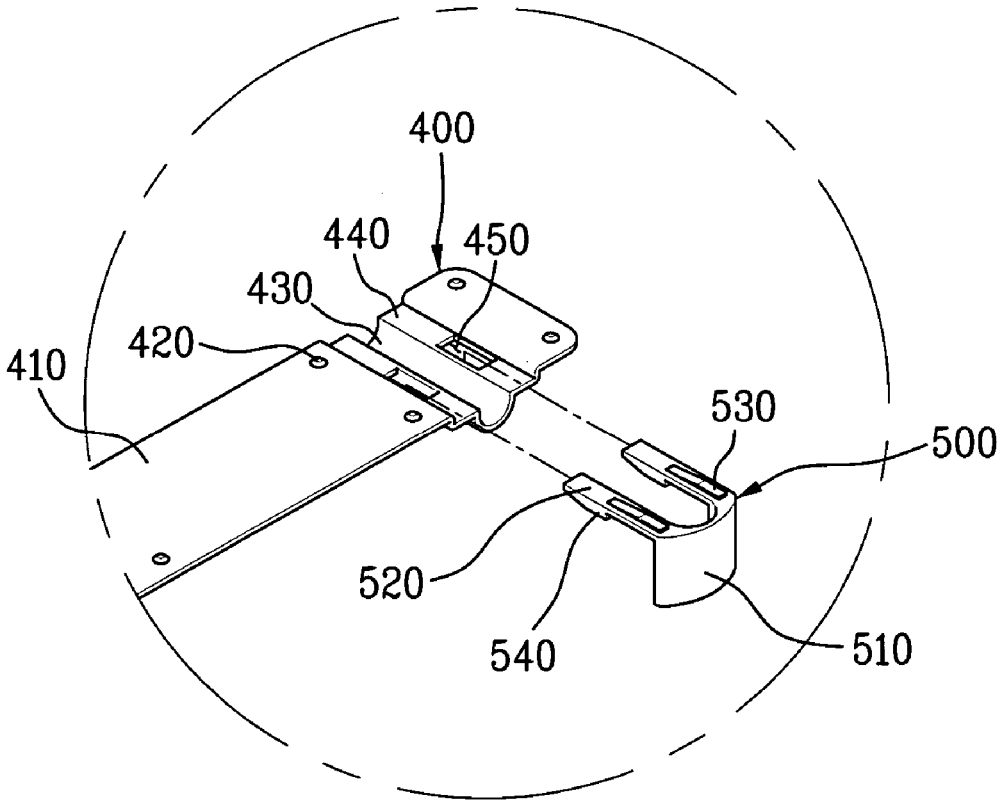
FIG. 6 is an exploded perspective view of a fixing unit according to the present invention.
Figure 7:
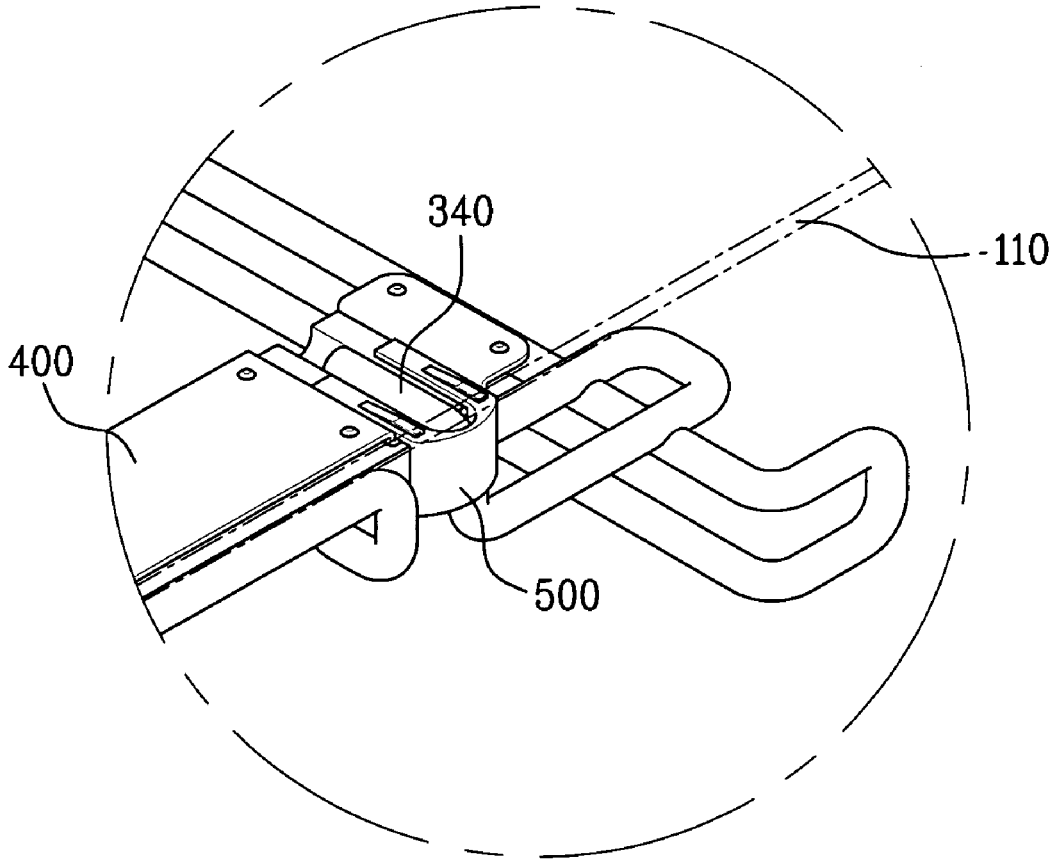
FIG. 7 is a perspective view illustrating that a fixing protrusion of a top rack guide according to the present invention is fixed.

FIG. 6 is an exploded perspective view of a fixing unit according to the present invention, and FIG. 7 is a perspective view illustrating that a fixing protrusion of a top rack guide according to the present invention is fixed.

Figure 1:
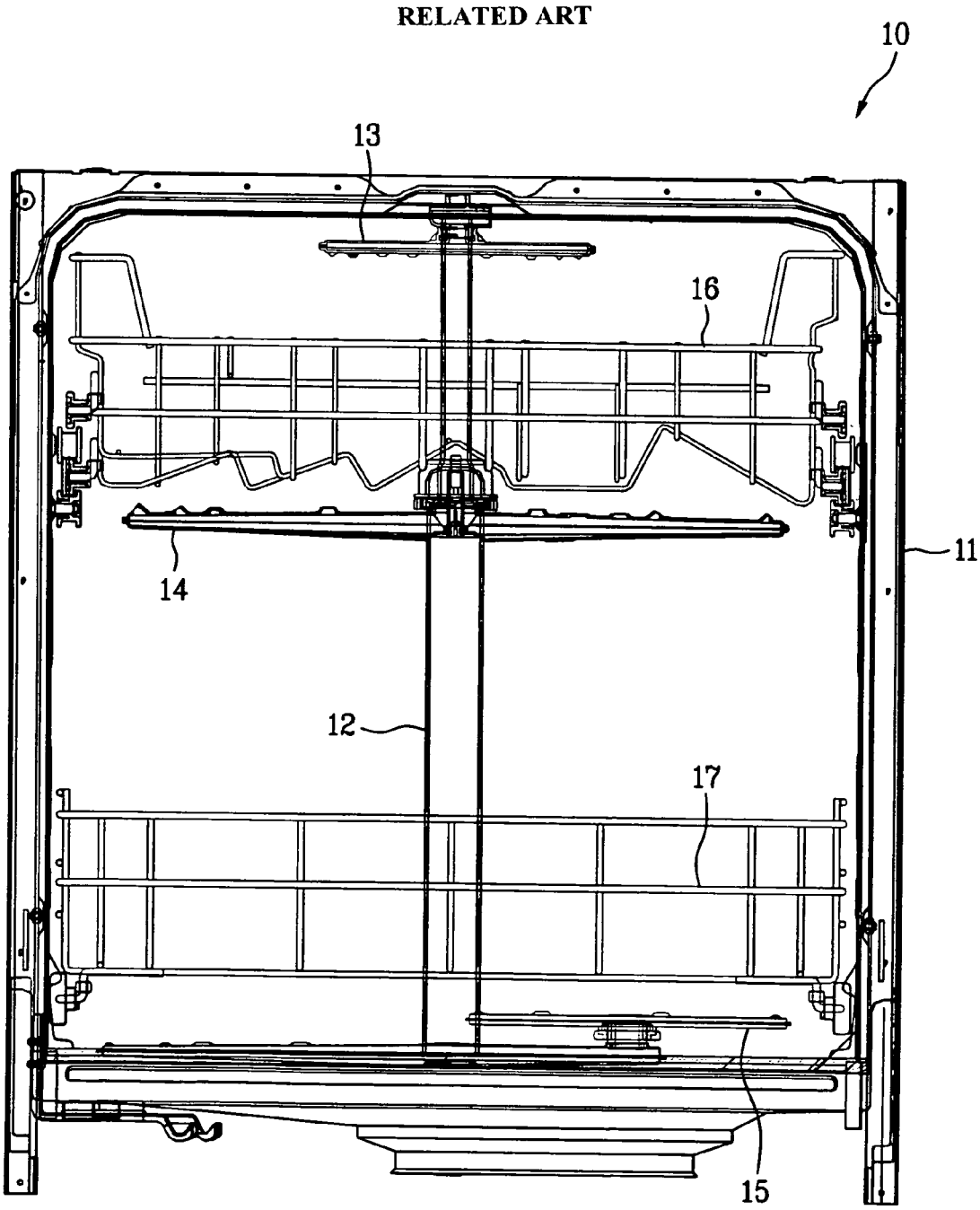
FIG. 1 RELATED ART
FIG. 1 is a front view of a dishwasher according to a related art.

Referring to FIGS. 6 and 7, the fixing unit 400 includes a fixing plate 410 and a fixing member 500. It is preferable that the fixing plate 410 be fixed to the inner ceiling of the tub (see 110 of FIG. 1). For this purpose, the fixing plate 410 has coupling holes 420 into which a coupling member coupled with the tub is inserted.

In addition, the fixing plate 410 has a fixing groove 430, which is formed at a predetermined portion thereof and into which the fixing protrusion 340 is inserted. Also, the fixing plate 410 has stepped portions formed at both side portions thereof.

The fixing member 500 is coupled with the fixing plate 410 after the fixing protrusion 340 is inserted into the fixing groove 430. The fixing member 500 includes a restraining part 510 and extending parts 520. It is preferable that the restraining part 510 be formed integrally with the extending parts.

The restraining part 510 restrains the fixing protrusion 340 inserted into the fixing groove 430 and the extending parts 520 extend from the restraining part 510 and are inserted into and fixed to the stepped portions 440.

For this purpose, each of the stepped portions has a groove 450 and each of the extending parts 520 has a hook 540 formed at a lower portion thereof and inserted into the groove 450. In other words, after the fixing protrusion 340 is inserted into the fixing groove 440, the extending parts 520 of the fixing member 500 are inserted into the stepped portions 440.

In order for the hook 540 to be inserted into the groove 450 and then stably fixed, it is preferable that a pushing protrusion 530 for pushing the fixing protrusion 340 toward a direction of the groove 450 be provided on the extending parts 520. Also, it is preferable that the hook 540 and the pushing protrusion 530 be formed integrally with the extending parts 520.

As shown in FIG. 7, after the fixing protrusion 340 is inserted into the fixing groove 440, the fixing unit 500 is coupled. At this time, the restraining part 510 restrains the bent portion of the fixing protrusion 340 inserted into the fixing groove 430, thereby preventing the fixing protrusion 340 from releasing.

Next, an assembling operation of the fixing unit will be described.

First, the fixing plate 410 is fixed to the upper inner circumference of the tub by a coupling member such as a screw or the like. Thereafter, the fixing protrusion 340 disposed above the top rack guide 300 is inserted into the fixing groove 430 formed at the fixing plate 410. Thereafter, the extending parts 520 of the fixing member 500 are inserted into the stepped portions 440 formed at both side portions of the fixing groove 430.

At this time, the hook 540 disposed at an end of the extending parts 520 is inserted into and fixed to the groove 450 formed at the stepped portions 440. The pushing protrusion 530 formed at each of the extending parts 520 pushes the hook 540 such that the hook 540 is closely in contact with the groove 450.

Meanwhile, when the fixing member 500 is completely coupled with the fixing plate 410, the restraining part 510 of the fixing member restrains the fixing protrusion 340, thereby preventing the fixing protrusion from releasing.

As described above, the dishwasher according to the present invention has the following effects:

First, since the top rack is installed at an inner ceiling of the tub, an upper marginal space inside the tub can be sufficiently utilized.

Secondly, since the top rack includes at least two receiving containers for receiving dishes having a small volume such as a spoon and chopsticks or a knife according to their kinds, it is unnecessary to form a separate receiving space in the upper rack or the lower rack other than in the top rack. Also, it is possible to more effectively receive the dishes in the racks.

Thirdly, since the fixing protrusion of the top rack guide is inserted into the fixing groove formed at the fixing plate and then the fixing member is coupled, it is possible to more easily fix the top rack guide to the ceiling of the tub.

Fourthly, since the top rack is frictionally slid along the top rack guide such that the top rack can be easily separated from the top rack guide, it is convenient to load or unload the dishes.

It will be apparent to those skilled in the art that various modifications and variations can be made in the present invention. Thus, it is intended that the present invention covers the modifications and variations of this invention provided they come within the scope of the appended claims and their equivalents.

What is claimed is:

1. A dishwasher comprising:

a tub having therein a space for washing dishes;

a top rack including at least one receiving container in which the dishes are received;

a top rack guide having at least one fixing protrusion disposed at an upper portion thereof, and disposed at an inner ceiling of the tub and receives an outer frame of the top rack such that the top rack frictionally slidingly moves along the rack guide by the outer frame; and a fixing unit for fixing the top rack guide to the inner ceiling of the tub comprising a fixing plate fixed to the inner ceiling of the tub and having a fixing groove into which the fixing protrusion is inserted; and a fixing member for preventing the fixing protrusion inserted into the fixing groove from releasing;

wherein the fixing protrusion is fixed by the fixing unit.

2. The dishwasher of claim 1, wherein the top rack comprises:

at least two receiving containers for receiving the dishes; and the rack frame having receiving parts for independently supporting the receiving containers and sliding along the top rack guide.

3. the dishwasher of claim 2, wherein the rack frame is made of a metal bar bent several times.

4. The dishwasher of claim 1, wherein the fixing member comprises:

a restraining part for restraining the fixing protrusion inserted into the fixing groove; and an extending part extending from the restraining part and coupled with the fixing plate.

5. The dishwasher of claim 1, wherein the top rack guide comprises:

guide rails having insertion holes into which both sides of the top rack are movably inserted in front and rear directions; and a connection part connecting the guide rails.

6. The dishwasher of claim 5, wherein the connection part is made of a metal bar and has a fixing protrusion bent in the shape of "L" at an upper portion thereof, the fixing protrusion having an end protruded toward a rear side of the tub.

7. The dishwasher of claim 1, wherein the fixing unit comprises:

a restraining part for restraining the fixing protrusion inserted into the fixing groove; and an extending part extending from the restraining part and inserted into and fixed to stepped portions formed at both sides of the fixing groove.

8. The dishwasher of claim 7, wherein each of the stepped portions has a groove, and the extending part has a hook formed at a lower portion thereof and inserted into the groove of the stepped portion and a pushing protrusion formed at an upper portion thereof, for pushing the fixing protrusion in a direction of the groove.

9. A dishwasher comprising:

a tub having herein a space for washing dishes;

a top rack including at least one receiving container in which the dishes are received;

a top rack guide having at least one fixing protrusion formed at an upper portion thereof, the fixing protrusion having an end portion protruded toward a rear side of the tub, the top rack guide being disposed at an inner ceiling of the tub and receives an outer frame of the top rack such that the top rack frictionally slidingly moves along the top rack guide by the outer frame; and a fixing unit for detachably fixing the fixing protrusion to the inner ceiling of the tub comprising a fixing plate fixed to of the inner ceiling of the tub and having a fixing groove into which the fixing protrusion is inserted; and a fixing member for fixing the inserted fixing protrusion.

10. The dishwasher of claim 9, wherein the fixing unit comprises:

a restraining part for restraining the fixing protrusion inserted into the fixing groove; and an extending part extending from the restraining part and inserted into and fixed to stepped portions formed at both sides of the fixing groove.

11. The dishwasher of claim 10, wherein each of the stepped portions has a groove, and the extending part has a hook formed at a lower portion thereof and inserted into the groove of the stepped portion and a pushing protrusion formed at an upper portion thereof, for pushing the fixing protrusion in a direction of the groove.

12. The dishwasher of claim 9, wherein the fixing protrusion is made of a metal bar bent in the shape of "L".

* * * * *